US005315929A

United States Patent [19]

Sundqvist

[11] Patent Number: 5,315,929

[45] Date of Patent: May 31, 1994

[54] FINE ADJUSTMENT MECHANISM FOR SCREEN PRINTING MACHINES

[76] Inventor: James W. Sundqvist, 31828 - 112th SE., Auburn, Wash. 98001

[21] Appl. No.: 941,184

[22] Filed: Sep. 4, 1992

[51] Int. Cl.[5] ..... B41F 15/36

[52] U.S. Cl. ..... 101/127.1; 101/DIG. 36; 33/621

[58] Field of Search ..... 101/115, 474, 126, 127, 101/127.1, 128, 128.1, DIG. 36; 333/614, 617, 620, 621

[56] References Cited

U.S. PATENT DOCUMENTS

| | | | |
|---|---|---|---|
| 2,613,595 | 10/1952 | Welden | 101/115 |
| 2,796,831 | 6/1957 | Heestand | 101/DIG. 36 |
| 3,098,431 | 7/1963 | Weaver | 101/126 |
| 3,828,671 | 8/1974 | Fuchs | 101/123 |
| 3,859,917 | 1/1975 | Bubley et al. | 101/123 |
| 3,889,629 | 6/1975 | Black | 118/6 |
| 3,946,668 | 3/1976 | Douthwaite et al. | 101/123 |
| 3,971,312 | 7/1976 | Carli | 101/114 |
| 4,084,504 | 4/1978 | Fuchs | 101/115 |
| 4,111,118 | 9/1978 | Green et al. | 101/123 |
| 4,315,461 | 2/1982 | Harpold | 101/115 |
| 4,381,706 | 5/1983 | Harpold | 101/127.1 |
| 4,388,862 | 6/1983 | Thomas, Jr. | 101/126 |
| 4,393,775 | 7/1983 | Cappel et al. | 101/365 |
| 4,517,894 | 5/1985 | Davis et al. | 101/126 |
| 4,571,864 | 2/1986 | Bopp | 38/102.5 |
| 4,722,272 | 2/1988 | Caruccio et al. | 101/126 |
| 4,907,506 | 3/1990 | Davis etal. | 101/115 |
| 4,949,635 | 8/1990 | Padula | 101/115 |
| 4,972,773 | 11/1990 | Barlow | 101/127.1 |
| 4,974,508 | 12/1990 | Andersen et al. | 101/115 |
| 5,020,430 | 6/1991 | Harpold et al. | 101/126 |
| 5,022,320 | 6/1991 | Szarka | 101/123 |

FOREIGN PATENT DOCUMENTS

| | | | |
|---|---|---|---|
| 154088 | 11/1981 | Japan | 101/127.1 |
| 1256 | 1/1984 | Japan | 101/126 |

OTHER PUBLICATIONS

Lawson Screen Printing Machine Co. Brochure, Jul. 1976, 2 pages.

*Primary Examiner*—Edgar S. Burr
*Assistant Examiner*—Stephen R. Funk
*Attorney, Agent, or Firm*—Christensen, O'Connor, Johnson & Kindness

[57] ABSTRACT

A holder for the frame of a printing screen is connected to an adjustment plate which, in turn, is mounted on a support arm assembly. The support arm assembly swings the holder up and down, toward and away from a printing platen. The adjustment plate has elongated slots for receiving eccentric lugs of manually rotatable cam members. The adjustment plate is normally fixed to the screen holder by a locking mechanism, but the locking mechanism is releasable so that the cam members can be rotated to effect a desired adjustment of the plate and the associated holder to achieve a desired registration of the printing screen relative to the printing platen. The support arm assembly also is adjustable to change the angle of the screen relative to the platen when the screen is lowered.

16 Claims, 5 Drawing Sheets

Fig. 2.
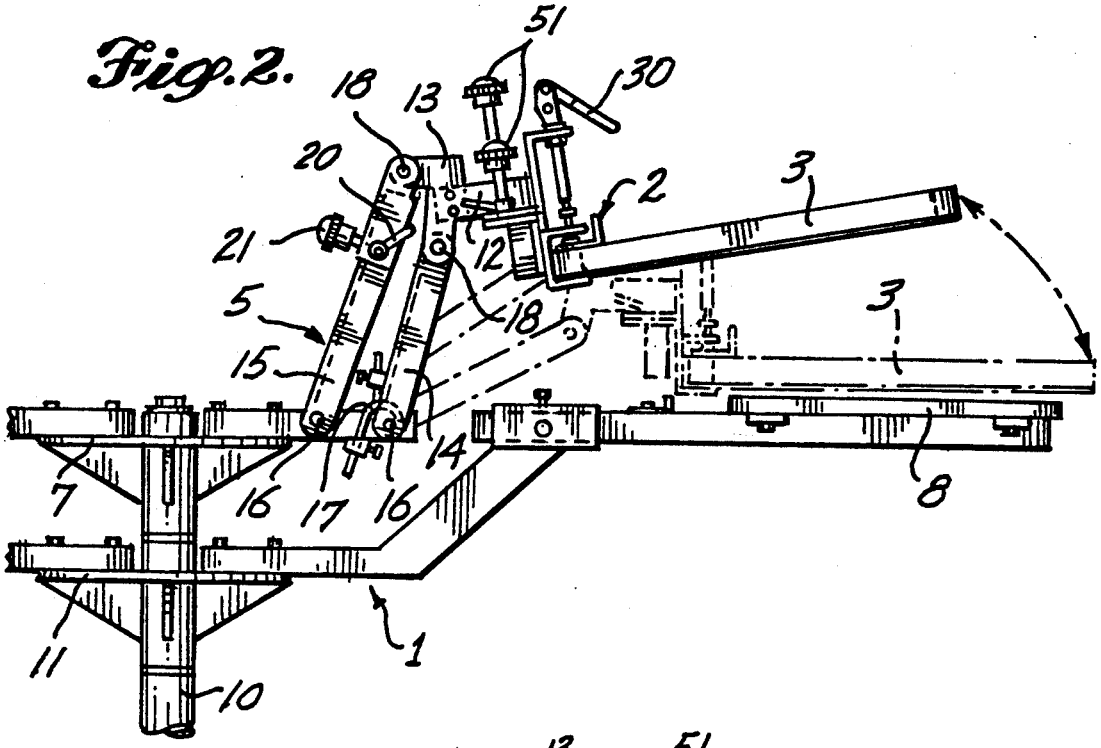
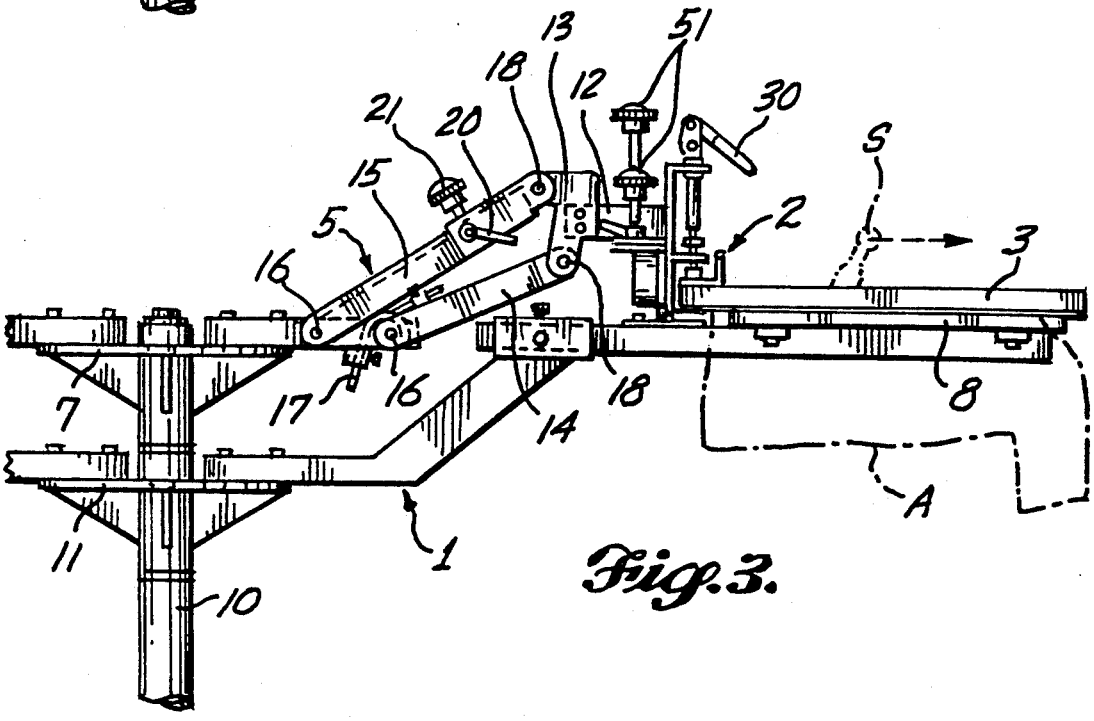
Fig. 3.

FINE ADJUSTMENT MECHANISM FOR SCREEN PRINTING MACHINES

FIELD OF THE INVENTION

The present invention relates to a mechanism incorporated in silk screen printing equipment for making precise adjustments of the screen position to assure proper registration over an article being printed.

BACKGROUND OF THE INVENTION

Multistation silk screen printing systems have two or more printing platens spaced around a stand. A turntable is mounted on the stand and carries two or more screen holders for swinging from one platen to the next. Separate screens are clamped in the holders. Each screen can be used for printing a specific color at each platen. It is important that the screens register with the printing platens precisely so that the finished print is well defined, rather than having the colors overlap or otherwise not be properly delimited. In conventional equipment, obtaining such precise registration requires adjustment of the positions of the screens in their holders.

SUMMARY OF THE INVENTION

The present invention provides a fine adjustment mechanism for screen printing machines in which a holder for the screen frame is movably mounted on a support arm assembly which swings the holder up and down, toward and away from a printing platen. An adjustment plate is interposed between the arm assembly and the holder. The adjustment plate has elongated slots for receiving eccentric lugs of manually rotatable cam members. The plate is normally fixed to the holder and the locking mechanism normally secures the adjustment plate in a selected position relative to the support arm assembly. The locking mechanism is releasable so that the cam members can be rotated to effect a desired adjustment of the plate and the associated holder for a desired registration of the screen relative to the support arm assembly and the printing platen. The support arm assembly translates the holder and its screen rearward away from a worker at a printing station as the arm assembly is swung up. The support arm assembly also is adjustable to change the angle of the screen relative to the printing station platen when the screen is lowered.

BRIEF DESCRIPTION OF THE DRAWINGS

FIG. 2 is a fragmentary side elevation of the machine of FIG. 1; and FIG. 3 is a corresponding fragmentary side elevation of such machine with parts in different positions;

DETAILED DESCRIPTION OF THE PREFERRED EMBODIMENT

Figure 1:
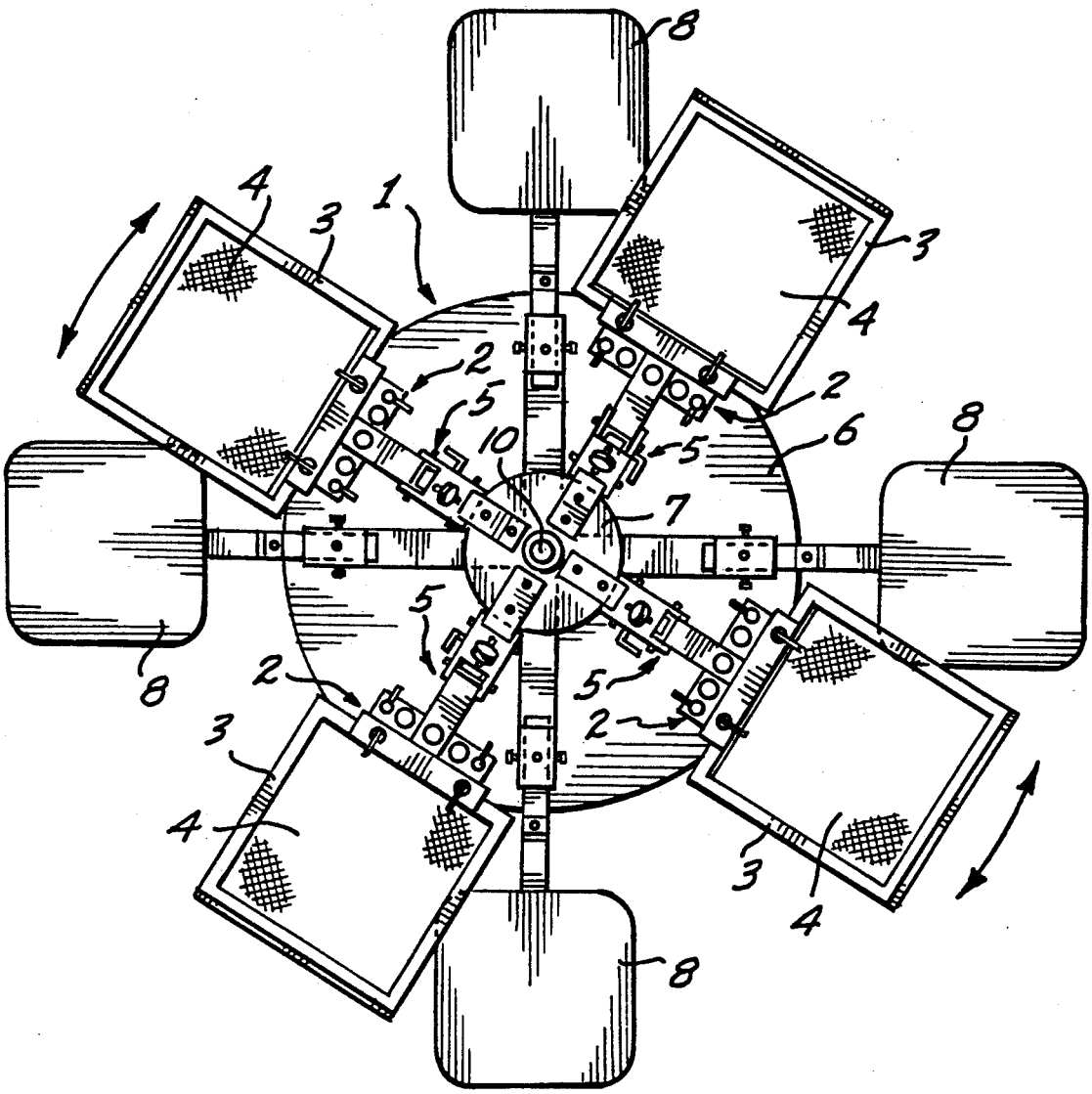
FIG. 1 is a somewhat diagrammatic top plan of a screen printing machine having fine adjustment mechanism in accordance with the present invention.

With reference to FIG. 1, a screen printing machine 1 in accordance with the present invention has one or more holders 2 for the structural frames 3 of printing screens 4. Each holder is carried at the end of a swingable support arm assembly 5. In the illustrated embodiment, four such support arm assemblies and holders are rotatably mounted on a stand 6 by a turntable 7 above four printing stations which include platens 8 for articles on which the designs of the screens 4 are to be printed. Adjacent holders, screens and platens are spaced 90° apart. For multiple color designs, ink is passed through the openings of one screen onto an article at one station, such as by a roller or squeegee, whereupon the screen frame is raised and an adjacent screen is moved into position for application of ink of a different color. In a multicolor printing operation, it is important that the screens be positioned precisely for a crisp appearance of the final printed design with each color properly delimited.

With reference to FIGS. 2 and 3, the stand 6 can include a central column 10 rotatably supporting a lower turntable 11 for the printing platens 8, as well as the upper turntable 7 for the support arm assemblies 5. Suitable indexing mechanism is provided to achieve alignment of the support arm assemblies with the platens 8 during printing. Such indexing mechanism and the support structure for the platens are conventional.

With respect to the support arm assemblies 5 mounted on the upper turntable 7, such support arm assemblies carry the holders 2 for the screen frames 3 for moving the screens between the raised position illustrated in solid lines in FIG. 2 and the lowered printing position illustrated in broken lines in FIG. 2 and in solid lines in FIG. 3. Preferably, the screen holder normally is fixed to a short horizontal support member 12 cantilevered outward from an upright link 13. Such link connects the outer ends of swinging arms 14 and 15 which have their inner ends connected to the turntable at radially spaced locations by pivot pins 16. A torsion spring 17 can be connected between the turntable and one of the swingable arms to at least partially counterbalance the arm and its screen holder so as to retain them raised or lowered.

The radially swinging arm 14 is shorter than the radially inner swinging arm 15, although preferably longer than one-half the length of the inner arm. The pins 16 connecting the swinging arms to the turntable are aligned horizontally, but preferably the pins 18 connecting the outer ends of the swinging arms to the upright link 13 are spaced apart both vertically and radially. The pivot for the lower and radially outer swinging arm 14 is below and outward of the pivot for the upper and inner arm 15. The upper arm 15 is formed in two parts, one of which is telescoped inside the other. Such two parts are normally secured together by clamping bolts but such bolts can be loosened by manipulation of a locking lever 20 and knob 21 allowing the effective length of the upper arm 15 to be adjusted.

The primary purpose for adjusting the effective length of the upper arm 15 is to swing the screen holder and screen about an axis perpendicular to the length of the support arm assembly without changing the position of the support arm assembly so as to position to the screen frame 3 precisely parallel to the printing platen 8 when the screen is in its lowered position illustrated in FIG. 3. Shortening the upper arm raises the unclamped end of the screen relative to the clamped end, and lengthening the arm has the opposite effect. With the screen in the desired lowered position extending parallel to the platen 8, ink is forced through the screen onto an article A supported on the platen, such as by use of a squeege S. Then the screen is raised to the position illustrated in FIG. 2.

The preferred construction of the support arm assembly 5, including the swinging arms 14 and 15 and connecting link 13, results in the screen being partially translated rearward as it is raised for convenient access to the article A. In addition, the frame is tilted at a small acute angle rearward and downward which helps to prevent ink from dripping onto the article or the floor. In conventional systems, the screen is typically fixed to a single arm such that if the screen is raised to a large degree for convenient access to the article being printed, it will be tilted severely and the ink may run off or drip from the inner portion of the screen, whereas if the screen is raised only slightly to a moderately tilted position, access to the article being printed can be difficult.

Figures 4, 5:
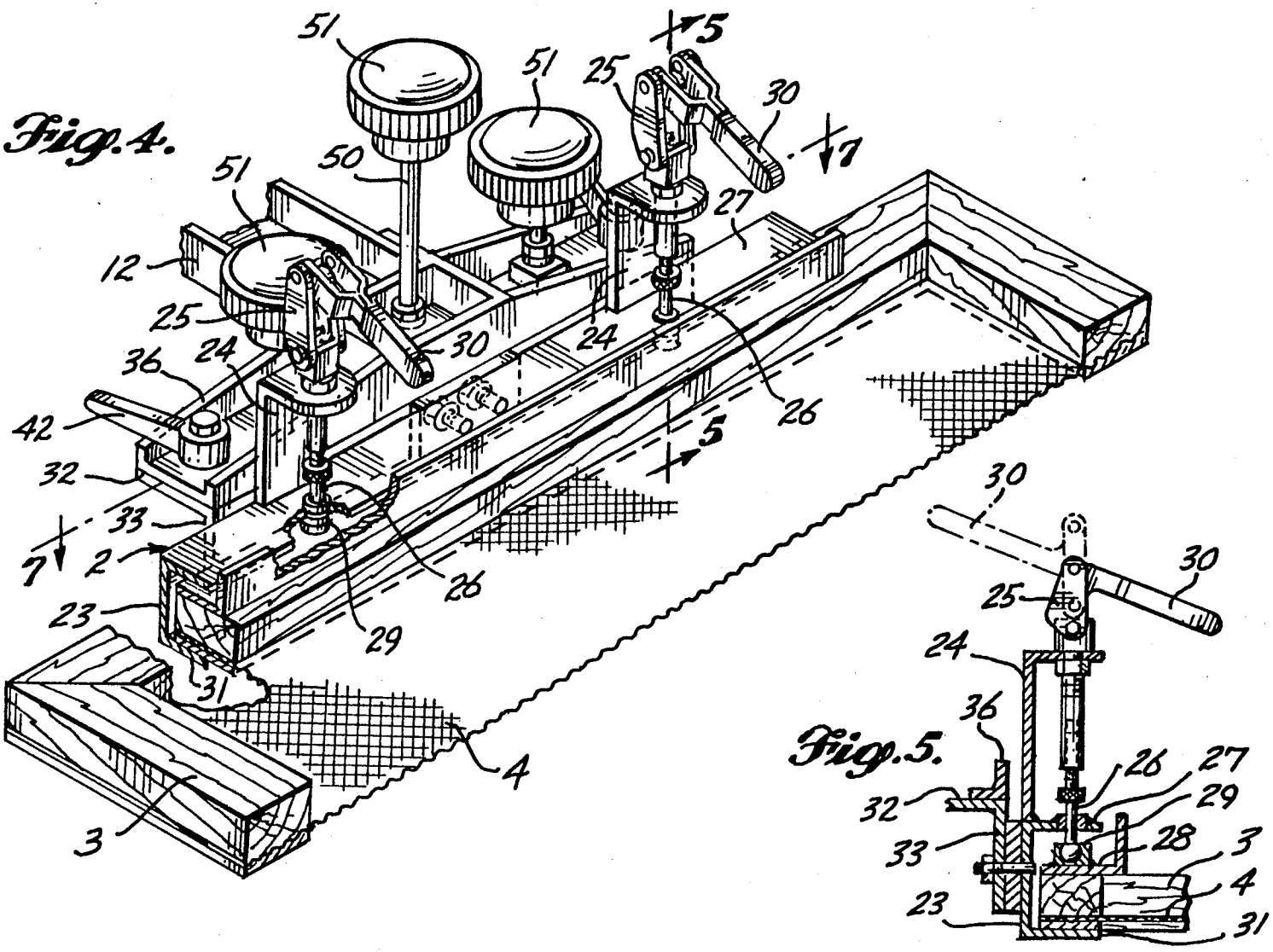
FIG. 4 is a fragmentary top perspective of a portion of the machine of FIG. 1, namely, the screen clamping assembly and fine adjustment mechanism.
FIG. 5 is a somewhat diagrammatic vertical section taken along line 5—5 of FIG. 4.
Figure 6:
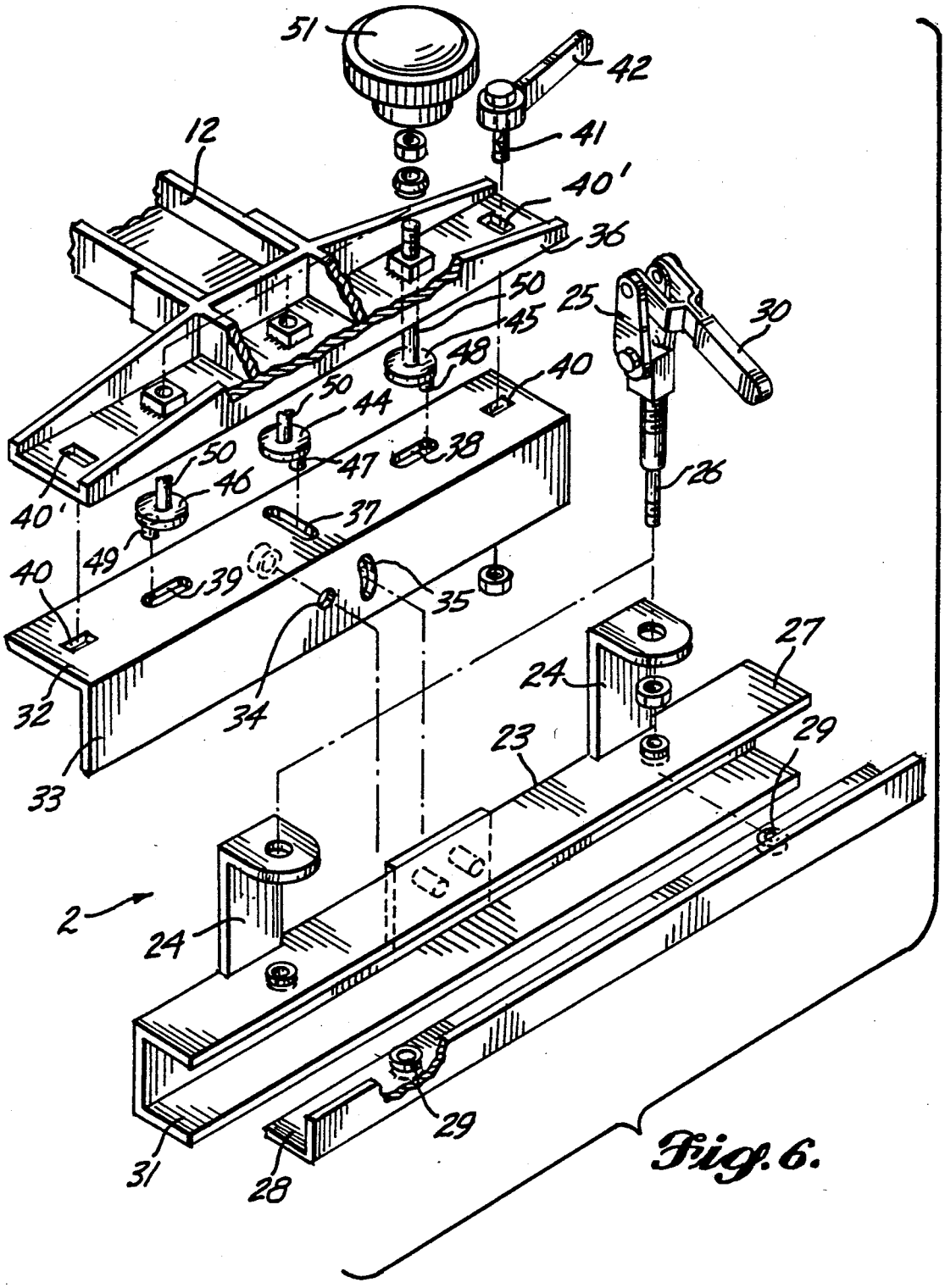
FIG. 6 is a top perspective of the holder and fine adjustment mechanism in accordance with the present invention with parts in exploded relationship.

The details of the screen holder 2 are shown in FIG. 4, FIG. 5 and FIG. 6. The mouth of a channel member 23 opens outward for receiving the structural frame 3 of the printing screen. Brackets or ears 24 project upward from the channel member 23 for mounting conventional toggle clamps 25. The reciprocating shafts 26 of such clamps extend downward through the top plate 27 of the channel member 23 and are connected to a long clamp plate 28 by conventional swivel joints 29. By manipulation of the actuating lever handles 30 of the toggle clamps, the clamp plate 28 can be locked in a downward projected position for clamping the screen frame 3 against the bottom plate 31 of the channel member 23.

In accordance with the present invention, an adjustment plate 32 is interposed between the holder channel member 23 and the cantilever support member 12 of the swinging support arm assembly. A connecting flange 33 projects downward from the adjustment plate 32 for bolting to the rear side of the upright web of the channel member 23. Preferably, the connecting flange 33 has a single circular bolt hole 34 at its center (FIG. 6) with an additional slot 35 concentrically arcuate relative to the bolt hole 34 for an additional connecting bolt. Thus, with the bolts loosened, channel member 23 can be tilted relative to flange 33 and adjustment plate 32 about an axis generally parallel to the length of the swinging support arm assembly to achieve a desired orientation of the screen holder 2 relative to the associated printing platen. Thereafter, the connecting bolts can be tightened to secure the adjustment plate 32 to the screen holder.

The upper portion of the adjustment plate 32 is elongated transversely of the length of the support member 12, in line with an upper, transversely extending connecting member 36 secured to the outer end of the support member 12. As seen in FIG. 6, such upper portion of the adjustment plate has a central slot 37 elongated transversely of the length of the plate. Slot 37 is flanked by slots 38 and 39, each of which is elongated lengthwise of the plate. Additional apertures 40 are provided at the outer end portions of the adjustment plate.

The connecting member 36 above the adjustment plate 32 has a through hole or aperture 37', 38', 39', or 40' in alignment with each of the slots and apertures 37, 38, 39, and 40, respectively. The outer apertures 40' of member 36 receive the shanks of clamping bolts 41 which have top lever arms or handles 42 and which are tightened with bottom nuts 43 for locking the connecting member 36 to the adjustment plate 32. With such locking levers loosened, the adjustment plate can be moved relative to the connecting member for adjusting the position of the screen holder relative to the swinging support arm assembly, including members 12 and 36 of the support arm assembly.

Figure 7:
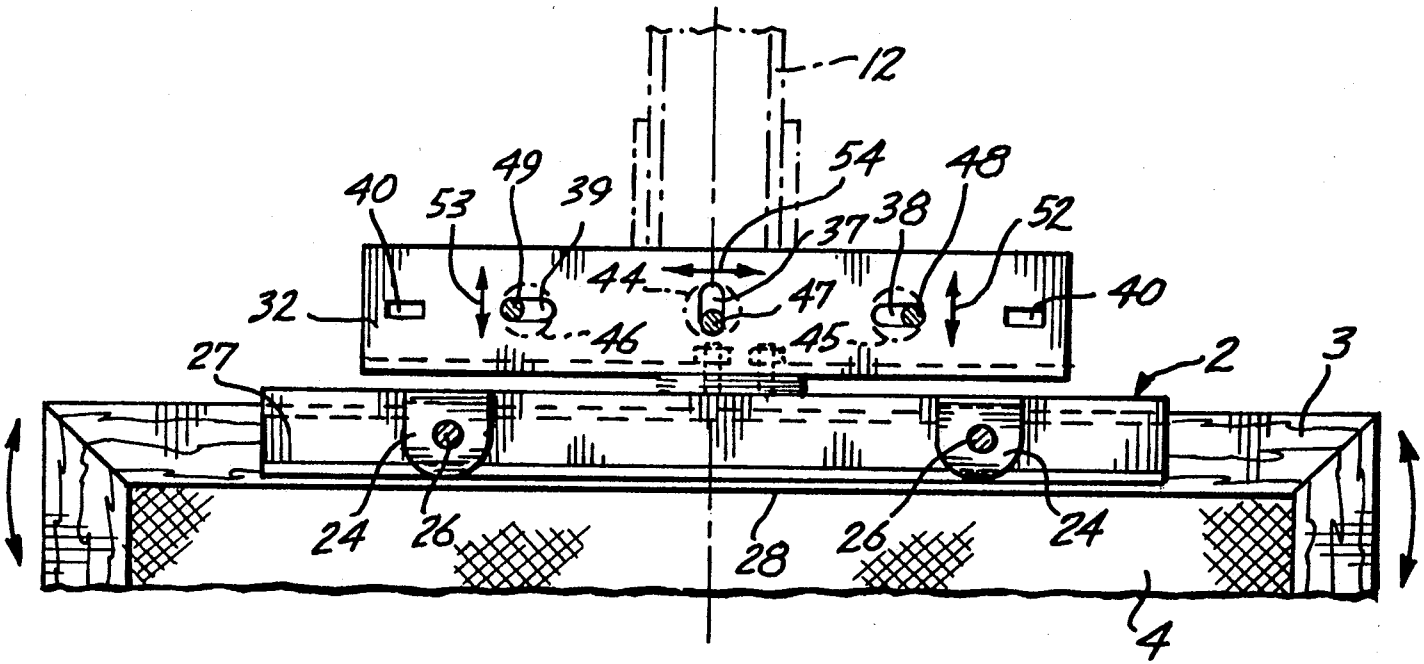
FIG. 7 is a somewhat diagrammatic section along line 7—7 of FIG. 4.

To achieve a quick and precise change in the position of adjustment plate 32 relative to connecting member 36, three cams 44, 45, and 46 have downward projecting lugs 47, 48, and 49, respectively, received in the slots 37, 38, and 39, respectively, of the adjustment plate. Such lugs are eccentric with respect to upward-extending shafts or shanks 50 which pass through the connecting member 36 and have large knobs 51 at their upper ends for manually rotating the cams. The adjustment action achieved by manually turning the knobs is best illustrated in FIG. 7. In the central position of the adjustment plate 32, lugs 48 and 49 are offset outward from the shafts of their cams such that small rotations of the associated knobs move the adjustment plate in and out relative to the support member 12 in generally the direction indicated by the arrows 52 and 53. In the central position of the adjustment plate, lug 47 of the center cam member is offset radially from its shaft such that small rotating motion of the associated knob moves the adjustment plate transversely in the direction of the arrow 54. Thus, with the locking bolts loosened the upper knobs 51 can be turned manually to achieve a desired precise adjustment of the screen holder relative to the support members 12 and 36, whereupon the outer locking levers 42 can be tightened to secure the holder in a desired registration relative to its swinging arm assembly.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A screen printing machine comprising a printing station, a screen holder, an elongated support arm assembly for supporting said screen holder and for moving said screen holder toward and away from said printing station between positions including a raised position and a lowered printing position, means for adjusting the position of said screen holder relative to said support arm assembly for achieving a desired registration of said screen holder at said printing station, said adjusting means including first adjustment means for swinging said screen holder about an axis extending substantially perpendicular to the length of said elongated support arm assembly without changing the position of said assembly between said raised position and said lowered printing position, second adjustment means for swinging said screen holder about an axis extending generally parallel to the length of said support arm assembly without changing the position of said assembly and third adjustment means for translating said screen holder relative to said elongated support arm assembly so as to adjust both the longitudinal and transverse position of said screen holder without changing the position of said assembly.

2. The machine defined in claim 1, including means for mounting the support arm assembly, the support arm assembly including a lower elongated arm having an inner end pivotally connected to said mounting means and an outer end remote from said mounting means, an upper elongated arm above said lower arm and having an inner end pivotally connected to said mounting means and an outer end remote from said mounting means, and the support arm assembly further including a generally upright link pivoted to said outer ends of said lower and upper arms and spacing them apart vertically, the screen holder being connected to and carried by said upright link for movement therewith, said link and said arms being constructed and arranged relatively so that the screen holder is translated inward from the printing station toward said mounting means as the support arm assembly is moved from its lowered printing position to its raised position and so that the screen holder is tilted upward relative to the printing station during such movement.

3. The machine defined in claim 2 in which the first adjustment means includes means for adjusting the effective length of one of the elongated arms so as to change the angular orientation of the upright link.

4. The machine defined in claim 1, in which the adjusting means includes an adjustment plate interposed between the screen holder and the support arm assembly, said adjustment plate including an upright flange, said second adjustment means including means for releasably securing the screen holder to said flange for allowing swinging of the screen holder relative to said flange.

5. The machine defined in claim 4, in which the second adjustment means includes mounting apertures in the upright flange of the adjustment plate including a first circular bolt hole and a slot concentrically arcuate relative to said bolt hole.

6. The machine defined in claim 1, in which the third adjustment means includes an adjustment plate interposed between the support arm assembly and the screen holder and means for releasably clamping said adjustment plate to the support arm assembly for allowing movement of said adjustment plate relative to the support arm assembly, said adjustment plate including a generally horizontally extending upper portion, said third adjustment means further including means separate from said clamping means interconnecting said upper portion of said adjustment plate with said support arm assembly, said interconnecting means including a rotatable cam member having an eccentric member and interfitting means on said adjustment plate to engage with said eccentric member such that, with said clamping mechanism released, rotation of said cam member translates said adjustment plate relative to the support arm assembly.

7. The machine defined in claim 6, in which the eccentric member includes an eccentric lug and the interfitting means includes an elongated slot interfitted with said lug.

8. The machine defined in claim 6, in which the upper portion of the adjustment plate includes an elongated slot forming part of the interconnecting means, the eccentric member being an eccentric lug fitted in said slot such that rotation of the cam member translates the adjustment plate relative to the support arm assembly.

9. A screen printing machine comprising a printing station, a screen holder, an elongated support arm assembly for supporting said screen holder and for moving said screen holder toward and away from said printing station between positions including a raised working position and a lowered printing working position, and means for adjusting the position of said screen holder relative to said support arm assembly for achieving a desired registration of said screen holder at said printing station, said adjusting means including an adjustment plate connected to said screen holder and means for interconnecting said adjustment plate with said support arm assembly, said interconnecting means including a rotatable cam member having an eccentric member and interfitting means on said adjustment plate to engage with said eccentric member such that rotation of said cam member translates said adjustment plate relative to said support arm assembly.

10. The machine defined in claim 9, in which the interfitting means includes an elongated slot in the adjustment plate, and the eccentric member being an eccentric lug carried by the rotatable cam member which lug is fitted in said slot such that rotation of said cam member translates the adjustment plate relative to the support arm assembly.

11. The machine defined in claim 9, including means for mounting the support arm assembly, the support arm assembly including a lower elongated arm having an inner end pivotally connected to said mounting means and an outer end remote from said mounting means, an upper elongated arm above said lower arm and having an inner end pivotally connected to said mounting means and an outer end remote from said mounting means, and the support arm assembly further including a generally upright link pivoted to said outer ends of said lower and upper arms and spacing them apart vertically, the adjusting means including means for adjusting the effective length of one of the support arms so as to change the angular orientation of the upright link and swing the screen holder connected thereto about an axis extending generally perpendicular to the length of the support arm assembly without changing the position of the support arm assembly between said raised position and said lowered printing position.

12. The machine defined in claim 11, in which the upright link and the upper and lower elongated arms are constructed and arranged relatively so that the screen holder is translated inward from the printing station toward the mounting means as the support arm assembly is moved from its lowered printing position to its raised position in addition to being tilted upward relative to the printing station during such movement.

13. A screen printing machine comprising a printing station, a screen holder, an elongated support arm assembly for supporting said screen holder and for moving said screen holder toward and away from said printing station between positions including a raised position and a lowered printing position, means for adjusting the position of said screen holder relative to said support arm assembly for achieving a desired registration of said screen holder at said printing station, said adjusting means including first adjustment means for swinging said screen holder about an axis extending substantially perpendicular to the length of said elongated support arm assembly without changing the position of said assembly between said raised position and said lowered position, second adjustment means for swinging said screen holder about an axis extending generally parallel to the length of said support arm assembly without changing the position of said assembly and third adjustment means for translating said screen holder relative to said elongated support arm assembly so as to adjust both the longitudinal and transverse position of said screen holder without changing the position of said assembly, said third adjustment means including an adjustment plate interposed between the support arm assembly and the screen holder and means for releasably clamping said adjustment plate to the support arm assembly for allowing movement of said adjustment plate relative to said support arm assembly, said adjustment plate including a generally horizontally extending upper portion, said third adjustment means further including means separate from said clamping means interconnecting said upper portion of said adjustment plate with said support arm assembly, said interconnecting means including a plurality of rotatable cam members having eccentric portions and interfitting means on said upper portion of said adjustment plate to engage with said eccentric positions such that, with said clamping mechanism released, rotation of said cam members translates said adjustment plate relative to the support arm assembly.

14. The machine defined in claim 13, in which the interfitting means includes at least one slot in the upper portion of the adjustment plate which slot is elongated generally lengthwise of the elongated support arm assembly and at least one other slot in the upper portion of the adjustment plate which other slot is elongated transversely of the support arm assembly, the plurality of rotatable cam members including two rotatable cams having the eccentric portions received in said elongated slots, respectively, such that rotation of one of said two cams has the effect of translating the adjustment plate generally transversely of the length of the support arm assembly whereas rotation of the other of said two cams has the effect of translating the adjustment plate generally longitudinally of the support arm assembly.

15. A screen printing machine comprising a printing station, a screen holder, an elongated support arm assembly for supporting said screen holder and for moving said screen holder toward and away from said printing station between positions including a raised position and a lowered printing position, and means for adjusting the position of said screen holder relative to said support arm assembly for achieving a desired registration of said screen holder at said printing station, said adjusting means including an adjustment plate connected to said screen holder and means for interconnecting said adjustment plate with said support arm assembly, said interconnecting means including a first slot in said adjustment plate which first slot is elongated generally lengthwise of said elongated support arm assembly and a second slot in said adjustment plate which second slot is elongated transversely of said support arm assembly, said interconnecting means further including a first rotatable cam member having an eccentric lug received in said first elongated slot and a second rotatable cam member having an eccentric lug received in said second slot, such that rotation of said first cam member has the effect of translating said adjustment plate generally transversely of the length of said support arm assembly whereas rotation of said second cam member has the effect of translating said adjustment plate generally longitudinally of said support arm assembly.

16. The screen printing machine defined in claim 15, in which the interconnecting means includes a third slot in the adjustment plate which third slot is elongated generally transversely of the support arm assembly, the first slot being positioned between the second slot and said third slot, said interconnecting means further including a third rotatable cam member having an eccentric lug received in said third slot such that rotation of said third cam member has the effect of translating said adjustment plate generally longitudinally of the support arm assembly.

* * * * *

UNITED STATES PATENT AND TRADEMARK OFFICE

CERTIFICATE OF CORRECTION

PATENT NO. : 5,315,929

DATED : May 31, 1994

INVENTOR(S) : J.W. Sundqvist

It is certified that error appears in the above-indentified patent and that said Letters Patent is hereby corrected as shown below:

| COLUMN | LINE | |
|---|---|---|
| [56] (Pg. 1) | Ref. Cited (U.S. Pat. Docs.) | "Welden" should read --Weldon-- |
| [56] (Pg. 1) | Ref. Cited (U.S. Pat. Docs.) | "etal." should read --et al.-- |
| 7 | 19 | "positions" should read --portions-- |

Signed and Sealed this

Twenty-seventh Day of September, 1994

*Attest:*

Bruce Lehman

BRUCE LEHMAN

*Attesting Officer*

*Commissioner of Patents and Trademarks*